US006886372B2

(12) United States Patent
Kropf

(10) Patent No.: US 6,886,372 B2
(45) Date of Patent: May 3, 2005

(54) VERTICAL AXIS WASHING MACHINE INCLUDING ROTATING/TIPPING AGITATOR

(75) Inventor: Keith E. Kropf, Newton, IA (US)

(73) Assignee: Maytag Corporation, Newton, IA (US)

( * ) Notice: Subject to any disclaimer, the term of this patent is extended or adjusted under 35 U.S.C. 154(b) by 209 days.

(21) Appl. No.: 10/318,062

(22) Filed: Dec. 13, 2002

(65) Prior Publication Data

US 2004/0111808 A1 Jun. 17, 2004

(51) Int. Cl.[7] ..... D06F 17/08
(52) U.S. Cl. ..... 68/23.7; 68/133; 68/134
(58) Field of Search ..... 68/23 R, 23.7, 68/133, 134, 53; 74/60; 475/163

(56) References Cited

U.S. PATENT DOCUMENTS

| | | | | |
|---|---|---|---|---|
| 1,553,690 A | | 9/1925 | Hogan | |
| 2,140,866 A | | 12/1938 | Whyte | |
| 2,145,453 A | | 1/1939 | Miller | |
| 2,186,786 A | | 1/1940 | Jensen | |
| 2,186,797 A | | 1/1940 | Beattie | |
| 2,215,288 A | | 9/1940 | Hays | |
| 2,350,218 A | | 5/1944 | De Remer | |
| 2,363,184 A | | 11/1944 | Jacobs | |
| 2,372,769 A | | 4/1945 | De Remer | |
| 2,438,273 A | * | 3/1948 | Easters | 68/152 |
| 2,520,366 A | | 5/1950 | Kirby | |
| 2,554,573 A | | 5/1951 | Johnson | |
| 2,555,400 A | | 6/1951 | De Remer | |
| 2,574,170 A | | 11/1951 | Cockerill et al. | |
| 2,645,111 A | | 7/1953 | Fields | |
| 2,658,372 A | | 11/1953 | Kirby | |
| 2,695,510 A | | 11/1954 | Clark | |
| 2,715,826 A | | 8/1955 | Kirby | |
| 2,823,975 A | | 2/1958 | Kirby | |

(Continued)

*Primary Examiner*—Frankie L. Stinson
(74) *Attorney, Agent, or Firm*—Diederiks & Whitelaw, PLC

(57) ABSTRACT

A tipping mechanism for a vertical axis washing machine includes an agitator, a drive member, a tipping member and a stationary pivot member. The pivot member preferably takes the form of a ball which is received in a socket defined by the tipping member. In a preferred form of the invention, the pivot member is provided with at least one guide member which is received in an arcuate channel, including both horizontal and vertical components, defined by the tipping member. In operation, the drive member causes the tipping member to rotate, while the arrangement of the guide member in the arcuate channel forces the tipping member to shift in various planes. This movement imparts a combination rotating and tipping motion to the agitator.

20 Claims, 3 Drawing Sheets

U.S. PATENT DOCUMENTS

| | | | | | |
|---|---|---|---|---|---|
| 2,831,333 | A | | 4/1958 | Smith | |
| 2,871,689 | A | | 2/1959 | Fields | |
| 2,878,662 | A | * | 3/1959 | Brucken | 68/19.2 |
| 2,902,851 | A | | 9/1959 | Fields | |
| 2,921,459 | A | | 1/1960 | Long | |
| 2,921,460 | A | | 1/1960 | Aberle | |
| 2,924,086 | A | | 2/1960 | Fields | |
| 2,931,201 | A | | 4/1960 | Hubbard | |
| 2,948,128 | A | | 8/1960 | Smith | |
| 2,974,515 | A | | 3/1961 | Smith et al. | |
| 2,982,120 | A | | 5/1961 | Pelensky | |
| 2,990,709 | A | | 7/1961 | Bochan | |
| 2,993,388 | A | | 7/1961 | Brill et al. | |
| 3,013,645 | A | | 12/1961 | Goodlaxson | |
| 3,063,280 | A | | 11/1962 | Bonner | |
| 3,067,603 | A | | 12/1962 | Devery | |
| 3,102,408 | A | | 9/1963 | Pelensky | |
| 3,102,410 | A | | 9/1963 | Doyle | |
| 3,279,224 | A | | 10/1966 | Zaidan | |
| 3,952,557 | A | | 4/1976 | Bochan | |
| 3,962,892 | A | * | 6/1976 | Garlinghouse | 68/23 R |
| 4,054,412 | A | | 10/1977 | Brummett et al. | |
| 4,328,600 | A | | 5/1982 | Bochan | |
| 4,440,004 | A | | 4/1984 | Bochan | |
| 5,460,018 | A | | 10/1995 | Werner et al. | |
| 5,504,955 | A | | 4/1996 | Mueller et al. | |
| 5,507,053 | A | | 4/1996 | Mueller et al. | |
| 5,791,167 | A | | 8/1998 | Wyatt et al. | |
| 5,878,602 | A | * | 3/1999 | Kovich et al. | 68/134 |
| 6,115,863 | A | * | 9/2000 | Mason et al. | 8/159 |
| 6,227,013 | B1 | * | 5/2001 | Wyatt-Smith | 68/134 |
| 2003/0061846 | A1 | * | 4/2003 | Skvarla et al. | 68/23.6 |
| 2003/0154749 | A1 | * | 8/2003 | Kim et al. | 68/23.6 |

* cited by examiner

VERTICAL AXIS WASHING MACHINE INCLUDING ROTATING/TIPPING AGITATOR

BACKGROUND OF THE INVENTION

1. Field of Invention

The present invention pertains to the art of washing machines and, more particularly, to a vertical axis washing machine including a rotating/tipping agitator.

2. Discussion of Prior Art

As environmentally friendly washing machines are more and more demanded by the public, manufacturers are faced with the problem of designing machines that use less water and, by extension, less energy to perform a washing cycle without causing a degradation in the quality of machine performance. One approach is to offer horizontal axis machines which use less water to thoroughly soak articles of clothing rotated within an inner tub. While this approach is an effective solution, it does not address the concerns of many consumers which, either by custom, or by spatial requirements, desire vertical axis machines.

Vertical axis machines have certain advantages over their horizontal axis counterparts. For example, vertical axis machines have fewer sealing requirements and therefore are less prone to leakage, and are arguably easier to load. For at least these reasons, many users find it advantageous to have a top loading machine. However, washing machine manufacturers find themselves faced with governmental regulations requiring more energy efficient laundry machines. In view of these new requirements, manufacturers have sought out designs which can make a vertical axis washer more energy efficient, while still being economically feasible. To this end, manufacturers have proposed various profile designs for agitators in attempting to more effectively move the wash load, or to vary the cycle to promote a better mixing of laundry. While each of these methods are effective to a degree, improvements are still deemed necessary.

The water level in a standard vertical axis machine cannot be lowered without negatively impacting wash performance. In addition, to effectively perform a wash cycle, the agitator must generate movement within the wash load as clothes tend to rest on the bottom of the machine and move in unison with the agitator. Tests on low water use machines have shown that some form of vertical motion is required to cause the wash load to turn over, thereby enabling each article of clothing to receive a corresponding amount of washing action.

Accordingly, a design that incorporates both the traditional oscillatory/rotating motion, coupled with a vertical or tipping motion, will enable a washing machine to use less water without negatively affecting wash quality. The prior art actually has many examples of machines that utilize a combination horizontal/vertical movement of clothing. However, most are either very complicated, possessing multiple failure points, or are not readily retrofittable to current designs, thereby not defining a cost effective solution. Accordingly, based on at least these reasons, there is a need in the art for a rotating/tipping agitator arrangement which will provide the necessary motion to clothing being washed in the tub of a vertical axis washing machine, while enabling the washing machine to utilize lower amounts of water, and be both easily serviceable and retrofittable into current designs.

SUMMARY OF THE INVENTION

The present invention pertains to a tipping mechanism designed to impart a combination rotating/tipping movement to the agitator of a clothes washing machine. In accordance with a preferred embodiment of the invention, the tipping mechanism includes an agitator, a driving member, a tipping member, and a stationary pivot member. The pivot member includes a ball portion having at least one guide member disposed on an outer surface of the ball portion, and a central bore through which a drive shaft extends. The tipping member is preferably constituted by two, substantially identical, saucer-like components having an outer peripheral rim, a central depression, and at least one additional guide member, preferably in the form of an arcuate channel having both vertical and horizontal components extending at least partially about the interface of the peripheral rim and the central depression. The two components are joined together over the ball portion to form a ball and socket mechanism with the guide members extending into the arcuate channel. The driving member is interposed between the tipping member and the agitator. Rotating/oscillating movement of the drive shaft is transmitted to the drive member which, in turn, causes both the tipping member and agitator to rotate about the pivot ball. At the same time, the guide members travel along the arcuate channels such that a combination rotating and tipping movement is imparted to the agitator.

With this construction, the present invention establishes a combination rotating and tipping movement for the agitator. The present invention lends itself to be readily retrofitted to current vertical axis machines. In any event, additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE INVENTION

Figure 1:
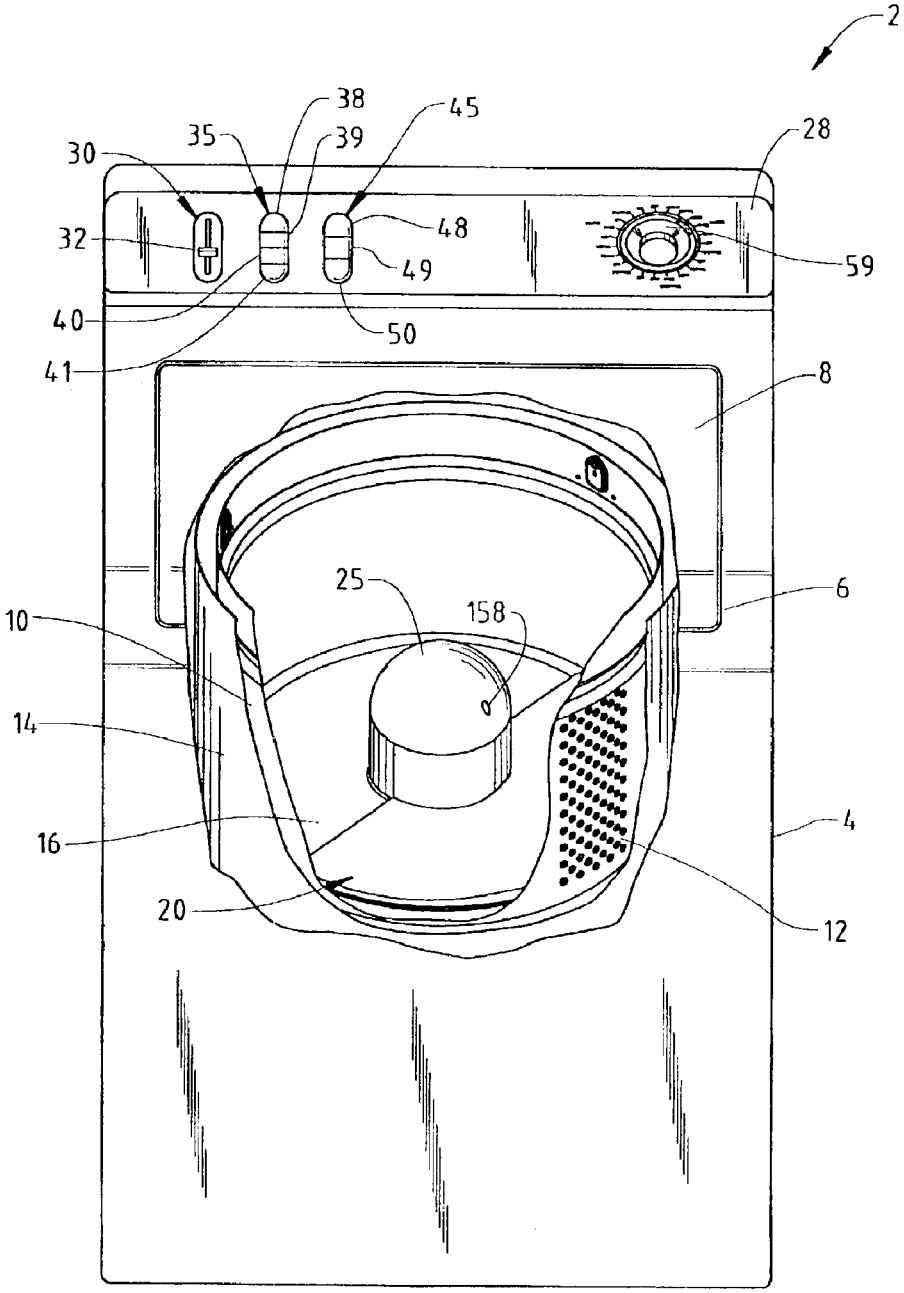
FIG. 1 is an upper perspective view of a top loading vertical axis washing machine incorporating a rotating and tipping agitator mechanism constructed in accordance with the present invention.

With initial reference to FIG. 1, a laundry appliance constructed in accordance with the present invention is generally indicated at 2. As shown, laundry appliance 2 includes an outer cabinet shell 4 provided with an upper opening 6 that can be selectively closed by means of a pivotable lid 8. In a manner widely known in the art, lid 8 can be raised to provide access to an inner tub 10 having a plurality of drain holes 12. Inner tub 10 is rotatably mounted within an outer tub 14 and is adapted to receive clothes to be laundered. Mounted within inner tub 10 is an agitator assembly 16 having a plurality of sloped plateaus or teeth 20 and a central hub portion 25.

At a rear portion of cabinet shell 4 is arranged a control panel 28 that includes various control units which can be used to program a desired laundering operation for appliance 2. In the embodiment shown, control panel 28 includes a first control unit 30 constituted by a vertically shiftable knob 32. Knob 32 is adapted to be shifted between raised and lowered positions in order to enable a user of appliance 2 to select a desired load size. Control panel 28 also includes a second control unit 35 that is defined by a plurality of buttons 38–41 provided for establishing wash and rinse temperatures. Adjacent second control unit 35 is a third control unit 45 defined by a plurality of buttons 48–50 which is used by a consumer to select a pre-established wash operation through the use of button 48, the application of a second rinse through button 49, and to cancel either of these control features through button 50. Finally, control panel 28 includes a rotary knob 59 which is used by a consumer to select a desired wash cycle.

The present invention is particularly directed to the mechanism and structure which enable agitator assembly 16 to simultaneously rotate about a rotational axis and pivot about a pivotal axis to impart a combination rotating and tipping washing movement to clothes being laundered within inner tub 10. More specifically, with reference to FIGS. 2 and 3, a tipping mechanism 65 is shown to include a pivot member 70 defining a pivot axis, a tipping member 75, and a drive member 80. Tipping member 75 is mounted for rotational and pivotal movement about pivot member 70. Drive member 80 transfers drive power to both agitator assembly 16 and tipping member 75. With this construction, the application of a rotational force to drive member 80 is simultaneously transmitted to both agitator assembly 16 and tipping member 75, while the interconnection between pivot member 70 and tipping member 75 causes simultaneous tipping of agitator assembly 16. Having described the interrelationship of the main components of the invention, a detailed description of each of the component parts follows.

In the most preferred form of the invention, pivot member 70 includes a rod 86 supporting a spherical pivot ball portion 89. Rod 86 includes a first end extending into and being fixedly secured to a housing (not shown) below inner tub 10, and a second end carrying pivot ball portion 89. Pivot ball portion 89 includes at least one guide member 94 which, in the preferred embodiment shown, constitutes a projection extending from an outer surface of ball 89. In one preferred form of the invention, a roller member 96 is mounted on each guide member 94. Pivot member 70 also includes a central bore 100 through which a rotating/oscillating drive shaft (not shown) extends. At this point, it should be understood that, while pivot ball portion 89 is described in terms of a spherical ball, other pivot members could be used to establish the pivot structure, including dome and other semi-spherical shaped members, multi-axis joints, and the like.

Figure 3:
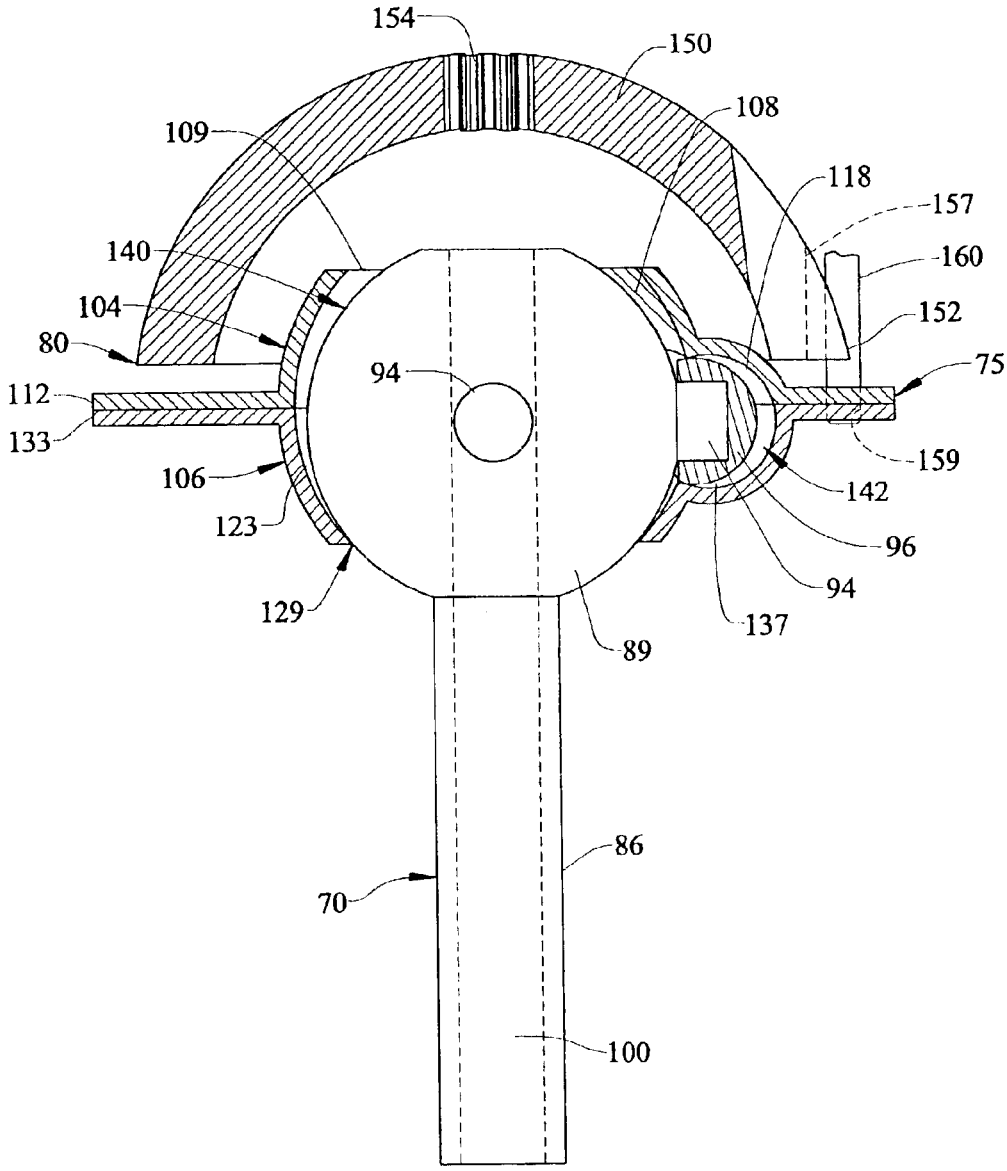
FIG. 3 is a sectional view of a portion of the rotating and tipping mechanism of FIG. 2.

With particular reference to FIG. 3, tipping member 75 includes an upper, saucer-like section 104 and a matching lower, saucer-like section 106. Upper section 104 includes an upper central depression 108 having an upper opening 109, an upper peripheral lip portion 112 extending about upper section 104 and an upper arcuate channel half 118 extending at least partially about upper section 104. Upper arcuate channel half 118 is positioned at the junction of upper central depression 108 and upper peripheral lip 112 and includes both a vertical component and a horizontal component.

In a like manner, lower section 106 includes a lower central depression 123 having a lower central opening 129, a lower peripheral lip portion 133 extending about lower section 106, and a lower arcuate channel half 137 extending at least partially about lower section 106. Lower arcuate channel half 137 is positioned at the junction of lower depression 123 and lower lip portion 133. Like upper arcuate channel half 118, lower arcuate channel half 137 includes both horizontal and vertical components.

In the most preferred form of the invention, upper section 104 and lower section 106 are assembled about pivot ball 89 of pivot member 70 and joined at peripheral lip portions 112 and 133 such that a central socket 140 and an arcuate channel 142, which also constitutes a guide member in accordance with the invention, are formed. Central socket 140 is sized to receive pivot ball 89, with the at least one guide member 94 extending into arcuate channel 142. In the most preferred form of the invention, the guide roller 96 mounted on each guide member 94 extends into arcuate channel 142 such that tipping member 75 is able to freely rotate about pivot member 70. In either case, when tipping member 75 is rotated about pivot ball 89 as will be detailed more fully below, guide member 94 travels within arcuate channel 142 thereby causing tipping member 75 to shift in both horizontal and vertical planes simultaneously.

Figure 2:
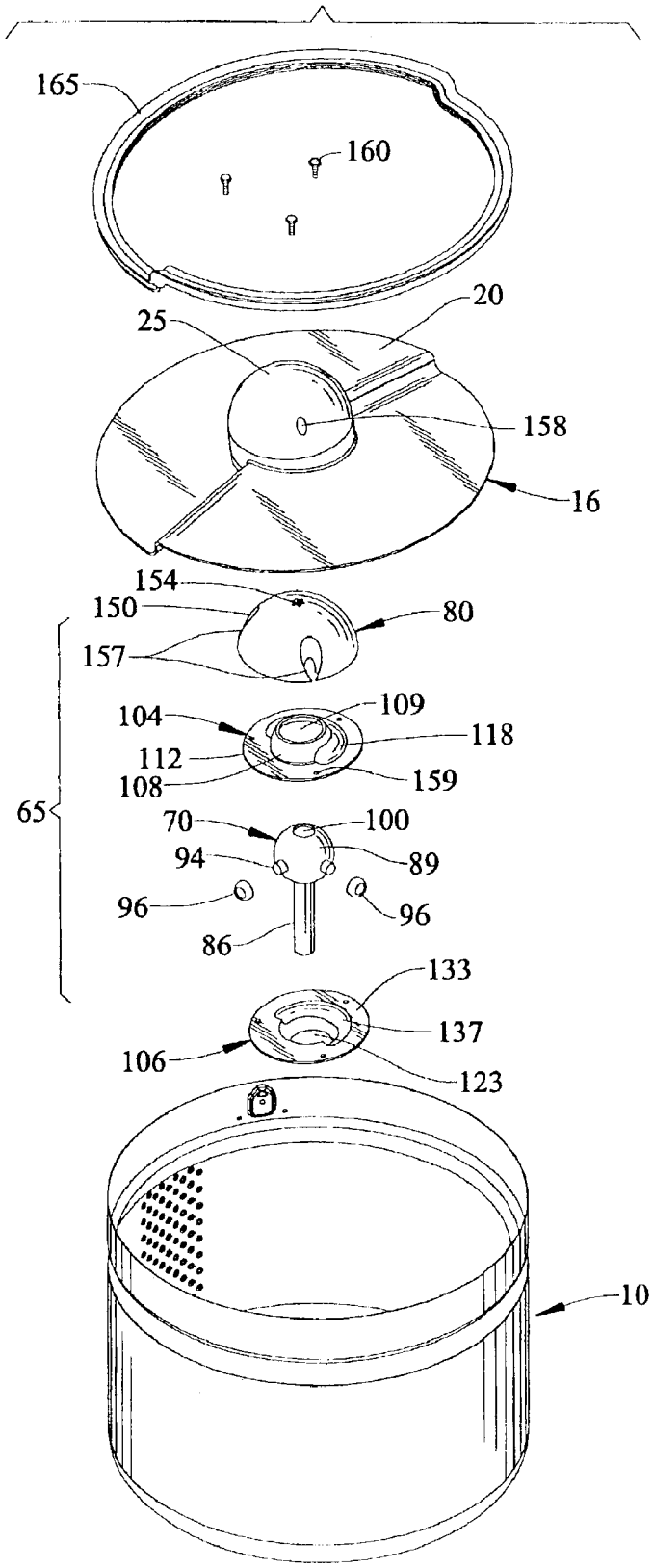
FIG. 2 is an exploded view of the rotating and tipping mechanism in accordance with a preferred form of the present invention.

As indicated above, drive member 80 functions to transfer drive power to both agitator assembly 16 and tipping member 75. In the most preferred form of the invention, drive member 80 includes a semi-spherical domed portion 150 including a lower portion 152 which is spaced above peripheral lip portion 112 of tipping member 75. As shown in FIG. 3, positioned at the apex of domed portion 150 is a drive shaft attachment point 154. In a preferred form of the invention, drive shaft attachment point 154 is constituted by a splined or threaded opening which is sized to receive a rotating/oscillating drive shaft (not shown). An outer peripheral portion of drive member 80 at lower portion 152 is provided with a plurality of radially outwardly open recesses 157 (see FIGS. 2 and 3) arranged about the periphery of lower portion 152, with recesses 157 being aligned with openings 158 in hub 25 and apertures 159 in lip portions 112 and 133 of tipping member 75. Various mechanical fasteners, indicated at 160 in FIGS. 2 and 3, are used to interconnect agitator 16 to tipping member 75, with each fastener 160 (three in the most preferred embodiment) extending within a respective recess 157 of drive member 80. Finally, a flexible seal 165 is provided about agitator 16.

Having described the various components of tipping mechanism, the operation of the invention will now be further detailed with reference to FIGS. 2 and 3. During operation of appliance 2, a rotating/oscillating drive shaft (not shown), which extends through central bore 100 of pivot member 70 and is fixed to drive member 80, imparts a rotary movement to drive member 80 about a rotational axis. Since mechanical fasteners 160, which directly interconnect agitator assembly 16 and tipping member 75, project through recesses 157, rotation of drive member 80 causes a similar rotation of tipping member 75 and agitator assembly 16 about the rotational axis. In addition, as tipping member 75 rotates about pivot ball portion 89, the at least one guide element 94 travels within arcuate channel 142. Being that arcuate channel 142 has both vertical and horizontal components, tipping member 75 is caused to further pivot about a pivotal axis defined by pivot ball 89 as guide element 94 travels within arcuate channel 142. This pivoting movement is made possible as lower portion 152 of drive member 80 is vertically spaced from peripheral lip portions 112 and 133 of tipping member 75. In the most preferred form of the invention, tipping member 75 shifts up and down about a total of 10°, although a greater range of motion can be readily accomplished by altering the configuration of arcuate channel 142. As agitator 16 is directly attached to tipping member 75, this motion causes a combination rotating/tipping movement of agitator 16 during a washing operation. This overall movement, in combination with plateaus of teeth 20, imparts a ratcheting action to a wash load, thereby reducing the required level of the wash water and providing an enhanced washing action.

Although described with respect to a preferred embodiment of the invention, it should be readily understood that various changes and/or modifications can be made to the invention without departing from the spirit thereof. For example, the relative locations of guide members 94 and arcuate channel 142 could be reversed, such that the arcuate channel is arranged about the pivot ball portion and the guide member(s) about the tipping member so long as the requisite guide path is established. In any event, the invention is only intended to be limited by the scope of the following claims.

I claim:

1. A washing machine comprising:

a cabinet shell;

an outer tub mounted within the cabinet shell;

an inner tub, including a lower portion, rotatably mounted within the outer tub;

an agitator arranged in the lower portion of the inner tub; and a tipping mechanism including:

a drive member adapted to be rotated during operation of the washing machine;

a pivot member extending at least partially above the lower portion of the inner tub, said pivot member including a first guide member exposed from an external surface thereof; and a tipping member pivotally mounted on the pivot member and drivingly interconnected to each of the drive member and the agitator, said tipping member including a second guide member, said first and second guide members being interengaged for relative movement along a guide path having a vertical component and a horizontal component, wherein rotation of the drive member during operation of the washing machine causes a combination rotating and tipping action to be imparted to each of the tipping member and the agitator.

2. The washing machine according to claim 1, wherein the agitator includes a central hub portion, said tipping member extending into the central hub portion.

3. The washing machine according to claim 1, wherein the tipping member defines a socket and the pivot member includes a pivot ball portion positioned in the socket.

4. The washing machine according to claim 3, wherein the tipping member includes an upper section, having a central depression and a peripheral lip portion, and a lower section, having a central depression and a peripheral lip portion, said upper and lower sections being mated at the peripheral lip portions, with the central depressions of the upper and lower sections collectively defining the socket.

5. The washing machine according to claim 4, wherein the first guide member extends from the external surface of the pivot member and the second guide member constitutes an arcuate channel into which the first guide member projects.

6. The washing machine according to claim 5, wherein the arcuate channel extends into each of the upper and lower sections of the tipping member.

7. The washing machine according to claim 5, wherein the tipping member is attached to the agitator about the peripheral lip portions of the upper and lower sections.

8. The washing machine according to claim 1, wherein the drive member is arranged between the agitator and the tipping member.

9. The washing machine according to claim 8, wherein said driving member includes a hub adapted to be drivingly connected to a rotatable drive shaft of the washing machine.

10. The washing machine according to claim 9, wherein the hub of the drive member is splined.

11. The washing machine according to claim 9, wherein the hub of the drive member is provided with a plurality of peripheral recesses, said tipping member being drivingly connected to the agitator through mechanical fasteners which extend through the recesses.

12. The washing machine according to claim 11, wherein the pivot member includes a shaft portion provided with an internal bore for receiving the rotatable drive shaft of the washing machine.

13. The washing machine according to claim 1, wherein the pivot member includes a shaft portion provided with an internal bore for receiving a rotatable drive shaft of the washing machine.

14. The washing machine according to claim 1, further comprising: a roller provided on the first guide member.

15. The washing machine according to claim 1, further comprising: a flexible seal extending about an outer periphery of the agitator, said seal being adapted to close a gap between the agitator and the inner tub.

16. The washing machine according to claim 1, wherein the agitator is provided with a plurality of sloped, plateau portions.

17. A method of washing a load of clothes placed on an agitator in an inner tub of a washing machine comprising:

rotating a drive member about a rotational axis during operation of the washing machine;

causing the drive member to rotate a tipping member, upon a pivot member, about the rotational axis;

enabling a rotatable drive shaft of the washing machine to extend through and freely rotate within the pivot member in order to drive the drive member;

guiding the tipping member, through an interconnection between the pivot member and the tipping member, to shift in multiple planes upon being rotated; and imparting movements of the tipping member to the agitator such that the agitator undergoes rotating and tipping motions while washing the load of clothes.

18. The method of claim 17, further comprising: preventing clothes from flowing in a gap between a periphery of the agitator and the inner tub during a washing operation.

19. A method of washing a load of clothes placed on an agitator in an inner tub of a washing machine comprising:

rotating a drive member about a rotational axis during operation of the washing machine;

causing the drive member to rotate a tipping member, upon a pivot member, about the rotational axis;

guiding the tipping member, through an interconnection between the pivot member and the tipping member, to shift in multiple planes upon being rotated by directing a guide member provided on the pivot member within an arcuate channel defined by the tipping member to establish the multiple plane shifting of the tipping member; and imparting movements of the tipping member to the agitator such that the agitator undergoes rotating and tipping motions while washing the load of clothes.

20. The method of claim 19, further comprising: enabling a rotatable drive shaft of the washing machine to extend through and freely rotate within the pivot member in order to drive the drive member.

* * * * *